United States Patent [19]

Shaw

[11] Patent Number: 4,938,268

[45] Date of Patent: Jul. 3, 1990

[54] DEFECTIVE WEFT THREAD REMOVAL FOR AN AS-SPUN WEFT THREAD SUPPLY

[75] Inventor: Henry Shaw, Vleteren, Belgium

[73] Assignee: Picanol N.V., Ieper, Belgium

[21] Appl. No.: 193,753

[22] Filed: May 13, 1988

[30] Foreign Application Priority Data

May 20, 1987 [BE] Belgium ..... 8700567

[51] Int. Cl.[5] ..... D03D 47/30; D03D 51/00

[52] U.S. Cl. ..... 139/116.2

[58] Field of Search ..... 139/116, 452, 1 C, 450; 57/261, 263; 242/35.5 R, 35.6 R

[56] References Cited

U.S. PATENT DOCUMENTS

| | | | |
|---|---|---|---|
| 2,769,599 | 11/1956 | Furst | 242/35.6 R |
| 4,463,909 | 8/1984 | Kiriake et al. | 242/35.5 A |
| 4,494,371 | 6/1985 | Morita et al. | 57/263 |
| 4,559,976 | 12/1985 | Araki et al. | 139/452 |
| 4,658,866 | 4/1987 | Takegawa | 139/452 X |
| 4,676,277 | 6/1987 | Gillespie et al. | 139/1 C |
| 4,682,633 | 6/1987 | Eisenlohr | 139/1 C |

FOREIGN PATENT DOCUMENTS

| | | | |
|---|---|---|---|
| 8700223 | 11/1988 | Belgium | 139/116.2 |
| 2404035 | 8/1975 | Fed. Rep. of Germany . | |
| 2824752 | 12/1979 | Fed. Rep. of Germany . | |

*Primary Examiner*—Andrew M. Falik

*Attorney, Agent, or Firm*—Bacon & Thomas

[57] ABSTRACT

A method and apparatus for weaving with non-cleaned or as-spun thread uses a cleaning or irregularity removing system between the yarn supply and the pick insertion device of the weaving machine. The cleaning system cooperates with the pick insertion device so that substantially continuous weaving can be maintained, and includes a thread joining device so that weft thread supply can be maintained following removal of an irregularity in the weft supply. Removal of an irregularity is carried out by removing the section of weft yarn containing the irregularity.

20 Claims, 5 Drawing Sheets

DEFECTIVE WEFT THREAD REMOVAL FOR AN AS-SPUN WEFT THREAD SUPPLY

BACKGROUND OF THE INVENTION

This invention concerns a method and apparatus for supplying as-spun weft thread to a pick insertion device of a weaving machine.

It is known that spinning of yarn yields yarn with irregularities such as thinnings, thickenings, knots, entanglements and wads. Such yarns are usually cleaned before they are used in a weaving machine. This is done using a device, itself common technology, which automatically removes those sections of the spun thread which show irregularities, and which then joins the yarn together again by splicing or the like. The cleaned yarn is then wound onto yarn packages, which can be used on weaving machines. Clearly, the process of cleaning the spun yarn on a separate device is a cost factor in the overall weaving process.

SUMMARY OF THE INVENTION

The aim of the present invention is to provide a method of weaving whereby the separate cleaning of the yarn is avoided, and which also prevents the above-mentioned irregularities from being woven into the cloth. To this end, the invention concerns a method of weaving in which a textile is formed by means of warp and weft threads, and in which the weft threads are introduced into a shed formed in the warp threads by a suitable weft mechanism, with the characteristic that the method consists essentially of: drawing the weft thread directly from a supply consisting of yarn packages, known as "cops", made up of non-cleaned or as-spun yarn, in particular yarn as obtained straight after spinning; then cleaning (i.e., removing the irregularities from) said yarn (weft thread) between the yarn supply and the pick insertion device; and finally inserting the cleaned thread into the shed, by means of the pick insertion device, as outlined above.

In a preferred embodiment of the invention, the method consists essentially of drawing the weft thread from a yarn supply made up of non-cleaned or as-spun yarn, leading it through a detection device to the accumulator of a thread accumulation mechanism, and then inserting it into the shed by means of a pick insertion device; whereby, if an undesired irregularity is detected by said detection device, then successively ensuring that: the accumulator in operation at the moment the irregularity passes the detection device is stopped; the section of thread present in the accumulator is removed so that the irregularity is removed with it; and the accumulator mechanism is made ready to start again.

The invention also concerns a weaving machine which uses this method, with the special characteristic that the weft mechanism on the machine consists of a combination of successively: a yarn supply consisting of non-cleaned or as-spun thread; a detection device to detect irregularities in the weft thread; a thread accumulation mechanism made up of at least one accumulator; a thread-removing device, which can operate in conjunction with the thread accumulation mechanism; a pick insertion device; and a control unit which controls the operation of all the above-mentioned components according to a signal from the detection device.

In a preferred embodiment, the invention also provides a method in which the weaving machine does not have to be stopped while the section of thread containing the irregularity is being removed. This is done using a multiple accumulation mechanism with at least two accumulators, so that while a section of thread containing an irregularity is being removed from one of the accumulators, the system switches over to the other accumulator, thereby enabling the weaving process to operate continuously.

BRIEF DESCRIPTION OF THE DRAWINGS

With reference to the appended drawings, wherein like reference numerals denote similar parts.

DETAILED DESCRIPTION OF PREFERRED EMBODIMENTS OF THE INVENTION

Figure 1:
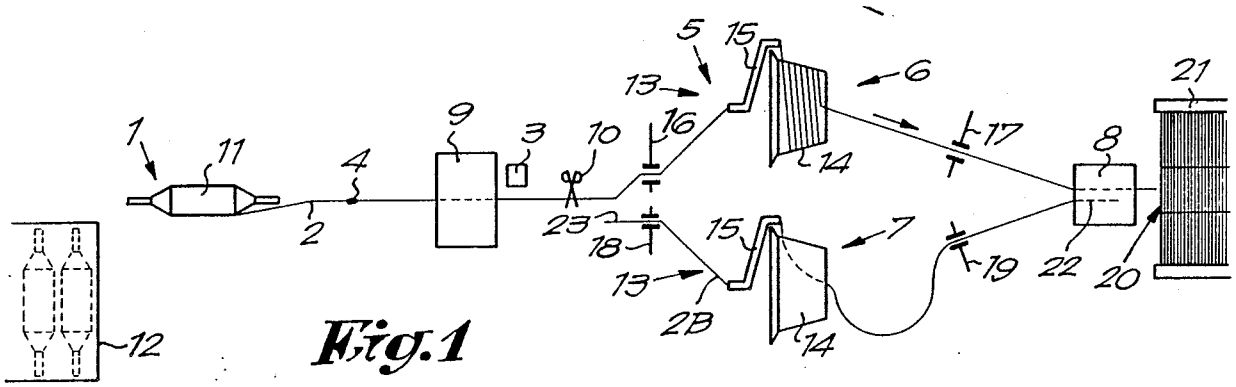
FIGS. 1 to 6 schematically show method and apparatus in accordance with this invention, in particular showing the exemplary method steps used to carry out a weft cleaning process during weaving.

As shown in FIG. 1, the weft mechanism on a weaving machine according to the invention consists essentially of a yarn supply 1 from which a weft thread 2 can be drawn, a detector device 3 in order to detect as-spun irregularities 4 (i.e., thinnings, thickenings, knots, entanglements and wads) in the weft thread 2, and a multiple accumulation mechanism 5 with at least two accumulators 6 and 7 which operate alternately, and a pick insertion device 8. Also shown in FIG. 1 are a thread-joining device 9 and a cutting device 10.

The yarn supply 1 consists essentially of an active yarn package 11 with non-cleaned or as-spun thread, also known as a "cop", and a package supply mechanism 12, which usually consists of a carrousel bearing several such yarn packages 11. Presentation of the new yarn package 11 and tying its leading end to the trailing end of the active package 11 can of course also be carried out automatically in accordance with known procedures.

The detection device 3, which is mounted in the path of the weft thread 2, can of course consist of any type of detector capable of detecting the irregularities 4, for example an optical detector, or a detection element which makes contact with the weft thread 2, etc.

In the embodiment shown, the weft accumulators 6 and 7 each consist essentially of a prewinder 13 with a winding tube 15 which rotates round the prewinder drum 14. They also incorporate a number of thread clips 16 to 19.

The pick insertion device 8 will depend on the type of weaving machine, and is only shown schematically. On an airjet weaving machine, it will consist of one or more main nozzles and perhaps also an automatic threading device for the main nozzle. On a rapier machine, this pick insertion device 8 will consist of a thread presentation device and/or color selector in order to insert the required thread into the shed 20 by means of a feed gripper; the thread can then be beaten up by the reed 21.

The abovementioned thread-joining device 9 is situated, or can be positioned, between the yarn supply 1 and the accumulation mechanism 5, and may consist of either a tying or a splicing device.

The preferred embodiment also incorporates a number of components which for the sake of clarity are only shown in a limited number of figures and which therefore will only be mentioned later in the course of this description.

Figure 2:
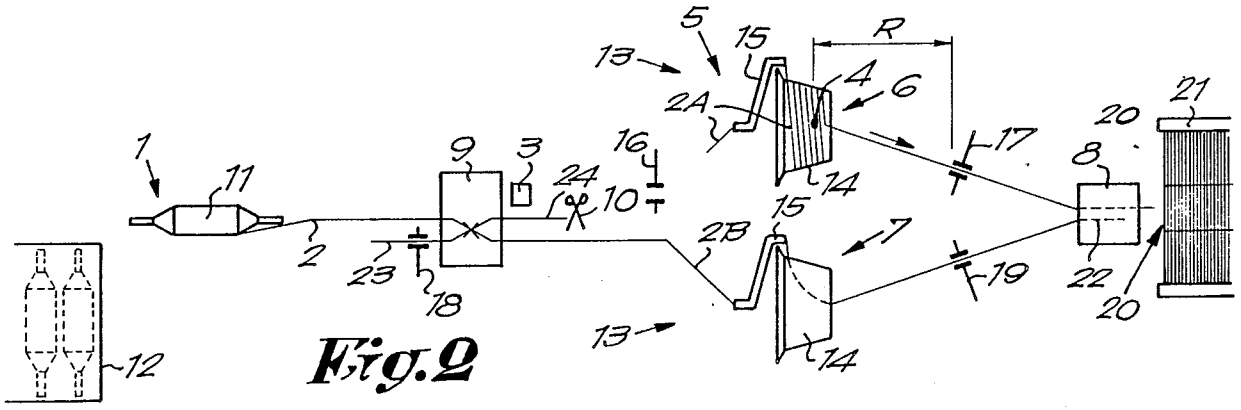

The method according to the invention is explained below on the basis of the operation of the preferred embodiment, the steps of which are illustrated in FIGS. 1 to 6. In the state shown in FIG. 1, the weft thread 2 is led to the pick insertion device 8 via the first accumulator 6. When an irregularity 4 occurs, it is detected by the detector 3. When this happens, the weft thread 2 continues to be led through the first accumulator 6 until the state shown in FIG. 2 is reached, i.e. until the irregularity 4 is located in the first accumulator 6, at the same time making sure that a significant reserve R of good thread remains available between the irregularity 4 and the pick insertion device 8. At this point the first accumulator 6 is deactivated. In the meantime the weft thread in use 2 is cut after the irregularity 4 by a cutting device 10, thus producing a separated section of thread 2A, for example as shown in FIG. 2.

In order to ensure continuous operations of the weaving process, the second accumulator 7 is activated. Here it should be noted that in this accumulator 7 there is already a second section of thread 2B, whose leading end 22 is being held in readiness for the pick insertion device 8. As shown in FIG. 2, the other end 23, together with the trailing end 24 of the original weft thread 2, is presented to the thread-joining device 9, for example by the motion of thread clip 18, and these two ends are then joined together. Thread can then be supplied via the second accumulator 7 by opening thread clip 19.

Figure 3:
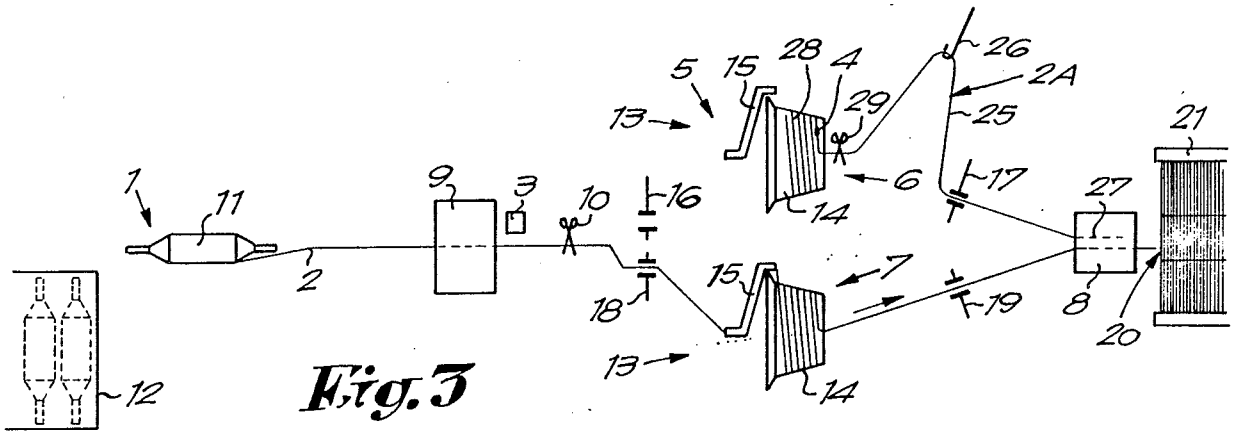
Figure 4:
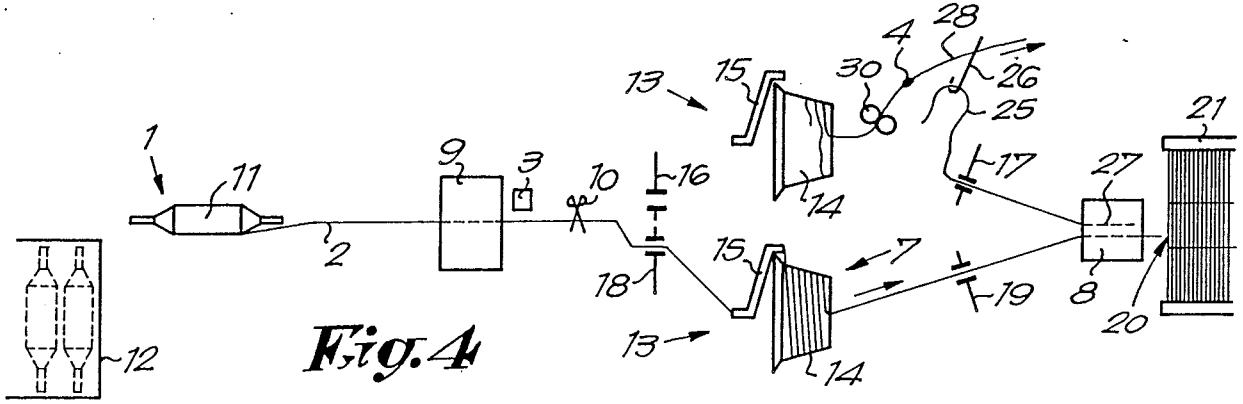

The irregularity 4 can be removed in the way shown in FIGS. 3 and 4. The good section of thread 25 remaining in the thread reserve R is first separated, for example by using a hooking device 26 to draw it off the corresponding prewinder 13. While doing so the clip 17 is closed so that the end 27 remains in the proximity of the pick insertion device 8. The thread section 28 containing the irregularity 4 is cut away by means of the cutting device 29, and then removed completely by means of an evacuation device 30, as shown in FIG. 4.

Figure 5:
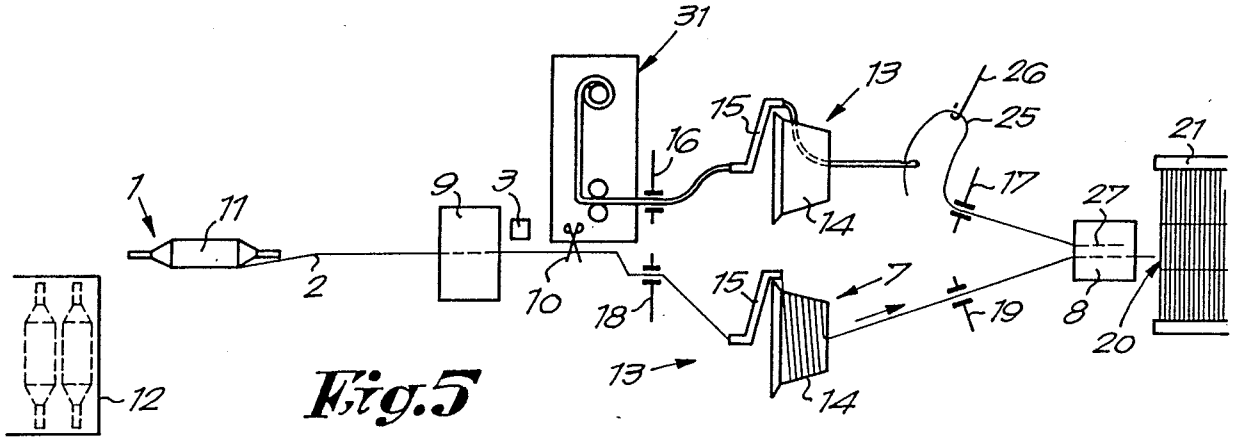
Figure 6:
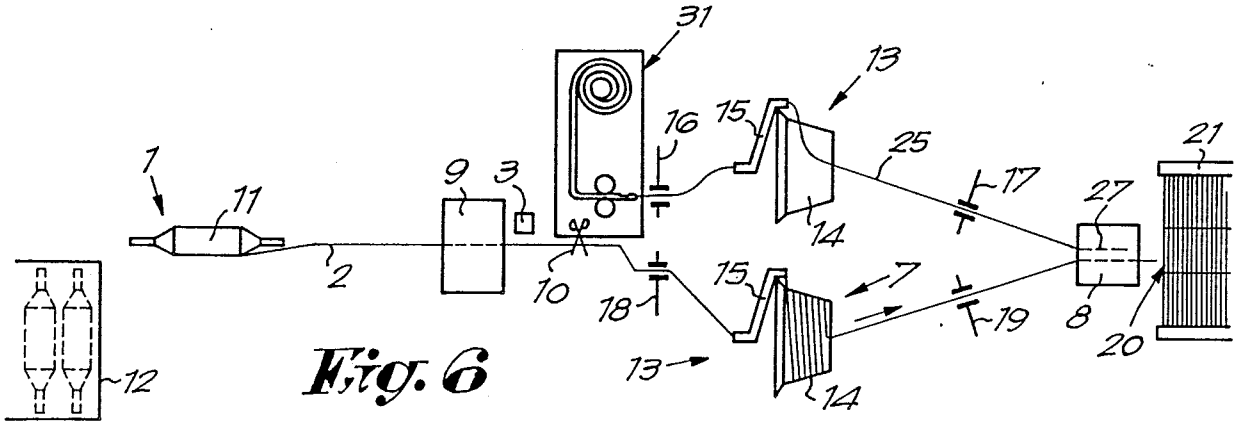

The first accumulator 6 is then be made ready for operation once more by rethreading it with the good section of thread 25, as shown in FIGS. 5 and 6. In the variant shown, this is done by means of an automatic threading device 31, as known from Belgian patent application No. 87 00223 made by the present applicant. The thread section 25 is thus brought into the thread clip 16.

The first accumulator 6 is then once ready to start operating once more when the next irregularity 4 occurs; when it does, the irregularity 4 will be removed via the second accumulator 7 in the same manner as described above for the first accumulator.

Clearly, the complete weft mechanism also incorporates a control unit in order to control the cycle just described, according to a signal from the detector 3.

Figure 7:
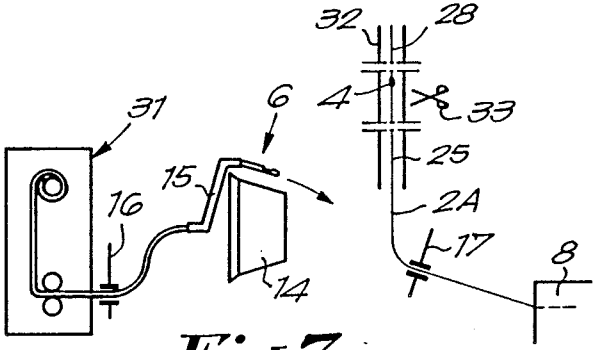
FIG. 7 shows an alternative weft cleaning device in accordance with the invention.
Figure 8:
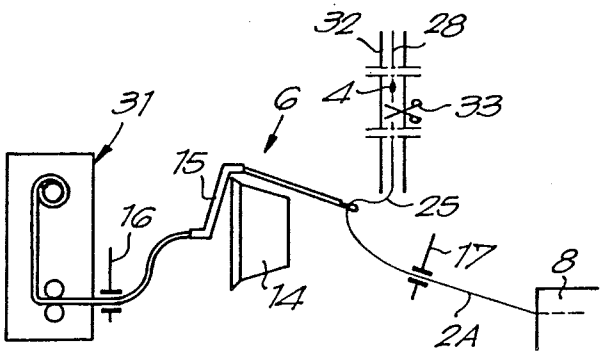
FIG. 8 shows a rethreading device useful with the embodiment shown in FIG. 7.

Separating the good and bad sections of thread, 25 and 28 respectively, does not necessarily have to be done by means of a hook 26 and an evacuation device 30. In the embodiment shown in FIGS. 7 and 8—which only show a part of the device—the whole length (including a reserve length) of the thread section 2A is drawn up into a tube off accumulator 14 after the weft has been cut behind the irregularity 4, 32 specially provided for the purpose, and the good and bad sections, 25 and 28 respectively, are separated by means of a cutting device 33. The good thread section 25 which extends to pick insertion device 8 is then led from tube 32 back through the accumulator 6 to the thread clip 16 by means of a threading device 31. Here it should be noted that drawing the thread section 2A into the tube 32 should preferably be done by sucking the thread into the tube 32. However, it could just as easily be blown in.

Figure 9:
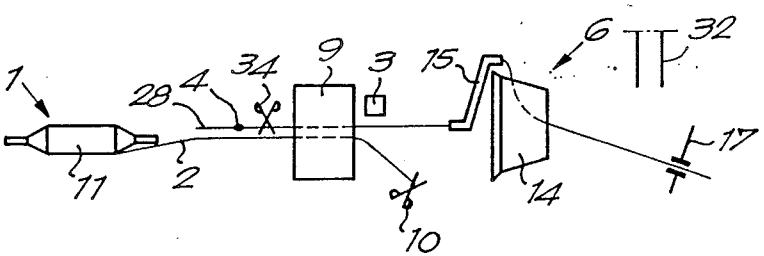
FIG. 9 shows an alternate thread cleaning and rethreading system.

In a variant, as shown in FIG. 9, the whole length of the section 2A including irregularity 4 can be drawn out of the tube 32 and through the accumulator 6 by means of the threading device 31, so that the irregularity is drawn back to the thread-joining device 9.

The bad section of thread 28 can then be cut away by means of the cutting device 34. For this purpose, the threading device 31 can be mounted before the thread-joining device 9, so that the latter is rethreaded when the thread section 2A is drawn through.

The present invention of course also concerns a weft mechanism and a method which uses only one accumulator. In this case, while the irregularity is being removed the thread supply to the weft mechanism is interrupted, so that the weaving machine has to be stopped temporarily.

Figure 10:
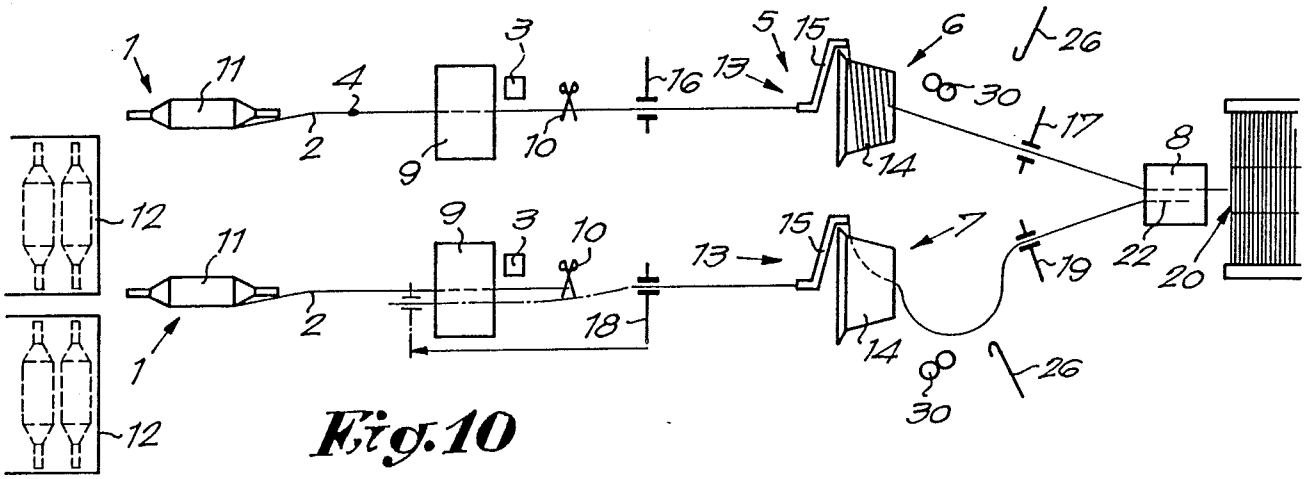
FIG. 10 shows an alternate embodiment of the invention, particularly the yarn supply and thread joining system.

As shown in FIG. 10, it is also possible to use two separate yarn supplies 1, each with its own thread 2 running through a separate thread-joining device 9, detection device 3, cutting device 10 and accumulator, 6 or 7, and possibly also through a separate thread-removal device, for example the abovementioned hooking device 26 and an evacuation device. Both weft threads 2 are then led to the same pick insertion device 8. The method used here is essentially that when an irregularity 4 is detected, the system switches over to the second weft thread while the irregularity is removed from the first, and vice versa. Clearly, it is also possible to work with more than two weft accumulators.

Figure 11:
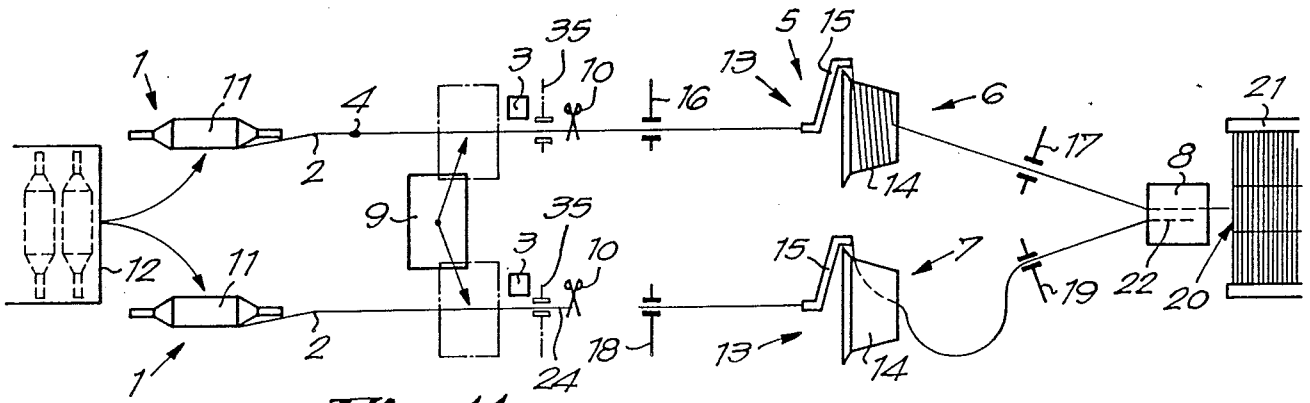
FIG. 11 shows an alternate embodiment of the system illustrated in FIG. 10.

FIG. 11 shows yet another variant of the weft mechanism shown in FIG. 10, in which a common package supply mechanism and thread-joining device 9 is used for both weft threads 2. The thread-joining device 9 can be presented alternately to each weft thread. When an irregularity 4 is removed from the weft thread 2, the thread ends 24 thus formed can be kept stretched out by means of other thread clips 35; these are necessary in particular during the absence of the thread-joining device 9.

Clearly, the invention is not limited to a thread accumulation mechanism 5 of the type which uses prewinders 13; given suitable means, e.g. the tube 32, the method of the invention can also be applied to other types of thread accumulator devices. Clearly also, the yarn supply 1 consisting of non-cleaned thread can be of any type.

The present invention is not limited to the examples described and the embodiments shown in the figures; on the contrary, such a weaving machine, equipped with the weft mechanism described above, can be made in all forms and dimensions while still remaining within the scope of the invention.

I claim:

1. A method of weaving a textile formed by warp and weft threads wherein weft threads are inserted into a shed by a pick insertion device comprising:

providing a yarn supply consisting of packages of non-cleaned, as-spun thread, including irregularities;

drawing the weft thread directly from the yarn packages and threading same to the pick insertion device for use during weaving;

detecting irregularities in the weft thread supplied during weaving before the irregularities reach the pick insertion device;

cleaning the weft thread of said detected irregularities by removing the section of thread containing the irregularities between the yarn supply and the pick insertion device while leaving a thread portion in the pick insertion device; and joining the thread ends remaining after the aforementioned removal step by joining a thread end from a yarn supply to a thread end available from the pick insertion device;

whereby only cleaned thread without as-spun irregularities is inserted into the shed by the pick insertion device.

2. A method as claimed in claim 1, wherein at least one weft accumulator is provided in advance of the pick insertion device, including threading said non-cleaned, as-spun thread onto said accumulator; stopping said at least one accumulator when an irregularity is detected and during the aforementioned irregularity removal step; and restoring the operation of the accumulator following the irregularity removal step.

3. The method as claimed in claim 2, wherein multiple accumulators are provided, including threading the non-cleaned, as-spun thread onto at least one of the accumulators during weaving; switching over to the use of another accumulator when an irregularity is detected in the supplied thread; leaving the section of thread containing the irregularity in or near the at least one accumulator previously in operation; cleaning the weft thread of the irregularity in accordance with said cleaning step; and preparing the at least one accumulator for resumption of operation.

4. The method as claimed in claim 3, including providing only a single yarn supply and threading the weft thread to the pick insertion device via one of said accumulators from said single yarn supply.

5. The method as claimed in claim 3, wherein a means for detecting irregularities, a means for severing the thread and a means for joining the thread ends are provided in advance of the accumulators and wherein switching of the thread to the other accumulator is carried out by (i) severing the thread then threaded to the one accumulator in use between the one accumulator and the irregularity detecting means upon detection of a thread irregularity; (ii) presenting an end of thread already threaded to the other accumulator to the thread end joining means; (iii) joining the latter thread end to the free end of thread extending from the yarn supply; and (iv) proceeding with the weaving operation using the other accumulator.

6. The method as claimed in claim 3, wherein a plurality of as-spun yarn supplies are provided, and including threading the weft threads to the pick insertion device from the yarn supplies via separate ones of said accumulators.

7. The method as claimed in any one of the claims 2–6, wherein each accumulator includes a prewinder and wherein the irregularity removal step is carried out by (i) upon stopping of an accumulator that is receiving the thread irregularity, placing the irregularity so as to leave a reserve length of thread consisting of a length of thread without an irregularity on the prewinder of the respective accumulator between the pick insertion device and the irregularity; (ii) drawing off at least a portion of the reserve length without the irregularity further off the prewinder; (iii) severing the thread so as to leave the irregularity on the prewinder; and (iv) removing the section of thread containing the irregularity by drawing it off the prewinder.

8. The method as claimed in any one of the claims 2–6 wherein the step of restoring the operation of the accumulator is carried out by drawing a section of thread without an irregularity previously supplied to the accumulator back through the accumulator and securing the section against longitudinal movement between the yarn supply and the accumulator.

9. The method as claimed in claim 8, including drawing the section of thread without the irregularity and previously supplied to the accumulator back to a thread joining device.

10. The method as claimed in any one of the claims 2–6, wherein the step of thread irregularity removal is carried out by (i) stopping the accumulator in use so that a reserve length of thread without irregularities is disposed between the detected irregularity and the pick insertion device; (ii) severing the thread behind the section of thread containing the irregularity; (iii) drawing the section of thread containing the irregularity off the accumulator and into a suction tube; (iv) severing the section of thread containing the irregularity from the reserve length and removing same via the suction tube; and (v) threading at least a portion of the reserve length back through the accumulator.

11. The method as claimed in any one of the claims 2–6 wherein the irregularity removal step is carried out by (i) stopping the accumulator in use so that an accessible reserve length of thread without irregularities is left between the irregularity and the pick insertion device; (ii) severing the thread behind the section containing the irregularity; (iii) drawing the section containing the irregularity off the accumulator by a suction tube; (iv) threading the section of thread containing the irregularity and at least a portion of the reserve length in stretched out condition back through the accumulator and through a thread joining device so that the irregularity is disposed between the yarn supply and the thread joining device; and (v) severing the irregularity from the thread.

12. In a weaving machine having a weft supply mechanism including a yarn supply means adapted to use as-spun, non-cleaned weft thread and a pick insertion device, the improvement comprising:

a detector for detecting as-spun weft thread irregularities in the weft thread while the weft thread is extended between the yarn supply means and the pick insertion device and while a section of weft thread containing an irregularity is disposed between a portion of weft thread extending from the section to the yarn supply and another portion extending from the section to the pick insertion device;

means for severing the section of weft thread containing the irregularity from the weft thread portion extending from the yarn supply and from the portion of weft thread extending to the pick insertion device at least while said portion extending to the pick insertion device is maintained so extended in response to the detection of an irregularity; and means for removal of the severed section from the portion of weft thread extending from the yarn supply and from the portion of the weft thread extending to the pick insertion device; and means for joining the severed ends of the weft thread portions extending from the yarn supply and to the pick insertion device.

13. The improvement as claimed in claim 12 including at least one weft accumulator between the detecting means and the pick insertion device, said joining means disposed between the yarn supply and the accumulator; means for stopping the at least one accumulator in response to detecting of an as-spun irregularity; said joining means arranged to join severed ends of weft thread extending from the yarn supply and to the pick insertion device, respectively, while the accumulator is stopped.

14. The improvement in a weaving machine as claimed in claim 13, including means for drawing off the section of weft thread containing a detected irregularity from the at least one accumulator while it is stopped; said severing means arranged to sever the irregularity at least from the weft thread extending from the yarn supply before it is drawn off the accumulator.

15. The improvement in a weaving machine as claimed in claim 14, including a plurality of accumulators individually and selectively usable with the pick insertion device; said means for stopping the accumulator arranged to stop the accumulator in use; means for severing the section of weft thread containing the detected irregularity at least from the yarn supply when the accumulator in use is stopped; and means for directing the supplied weft thread to another accumulator and the pick insertion device upon the detection of an as-spun irregularity in the supplied weft thread.

16. The improvement in a weaving machine as claimed in claim 14, including means for severing the detected weft thread irregularity from the weft thread portion extending to the pick insertion device after the first mentioned accumulator is stopped.

17. The improvement as claimed in claim 14 wherein said severing means includes a severing device between the yarn supply and the accumulator, and said drawing off means comprises a suction tube adjacent the accumulator arranged to draw the weft thread section including the severed as-spun irregularity off the accumulator while the weft thread remains threaded to the pick insertion device.

18. The improvement as claimed in claim 17, said severing means including a severing device associated with the suction tube for severing the section of weft thread including the as-spun irregularity while it is disposed in the suction tube, whereby the irregularity may be removed from the weft supply mechanism by suction.

19. The improvement in a weaving machine as claimed in claim 16, including means for threading the free end of the weft thread extending to the pick insertion device back through the first mentioned accumulator.

20. The improvement as claimed in claims 13 or 15, wherein the severing means is disposed between the yarn supply and the accumulator or accumulators.

* * * * *